US005896628A

United States Patent [19]

Oda

[11] Patent Number: 5,896,628

[45] Date of Patent: Apr. 27, 1999

[54] AUTO-LOCK SLIDE FASTENER SLIDER

[75] Inventor: Kiyoshi Oda, Toyama, Japan

[73] Assignee: YKK Corporation, Tokyo, Japan

[21] Appl. No.: 08/938,955

[22] Filed: Sep. 26, 1997

[30] Foreign Application Priority Data

Sep. 30, 1996 [JP] Japan ..... 8-259256

[51] Int. Cl.[6] ..... A44B 19/30

[52] U.S. Cl. ..... 24/421

[58] Field of Search ..... 24/420, 421, 422, 24/418

[56] References Cited

U.S. PATENT DOCUMENTS

| | | | |
|---|---|---|---|
| 4,081,883 | 4/1978 | Ishii et al. | 24/421 |
| 4,139,928 | 2/1979 | Aoki et al. | 24/421 X |
| 4,422,220 | 12/1983 | Oda . | |
| 4,719,673 | 1/1988 | Kubo | 24/421 |
| 4,768,263 | 9/1988 | Fukuroi et al. | 24/421 X |
| 5,031,286 | 7/1991 | Kedzierski | 24/421 |

FOREIGN PATENT DOCUMENTS

| | | | |
|---|---|---|---|
| 0 251 316 | 1/1988 | European Pat. Off. . | |
| 0 365 910 | 5/1990 | European Pat. Off. . | |
| 821650 | 10/1959 | United Kingdom | 24/421 |

*Primary Examiner*—James R. Brittain
*Attorney, Agent, or Firm*—Hill & Simpson

[57] ABSTRACT

In an auto-lock slide fastener slider, an upper wing of a slider body has front and rear lugs on its upper surface, a through-hole under the front lug, a pair of locking-spring-supporting seats at opposite sides of the through-hole, a locking-pawl-insertion hole under the rear lug, and a cam-receiving recess between the lugs. A pull tab has a cam on an eccentric axle. A locking leaf spring has a streamlined central base, a front end portion at a front end of the base, a locking pawl at a rear end of the base, front and rear openings near the opposite ends of the base, and an oblique engaging strip projecting fra the front end of the base and engageable with the front lug. The spring is placed over the pull tab's cam, which is received in the cam-receiving recess of the upper wing, with the openings being threaded by the lugs and with the front end portion fixed to a guide post of the slider body.

6 Claims, 5 Drawing Sheets

AUTO-LOCK SLIDE FASTENER SLIDER

BACKGROUND OF THE INVENTION

1. Field of the Invention:

This invention relates to an auto-lock slider for use in an ordinary-type slide fastener, and more particularly to an auto-lock slide fastener slider in which a locking pawl of a locking leaf spring is brought into and out of engagement with fastener elements in response to pivotal movement of a pull tab between a horizontal posture and an upright posture.

2. Description of the Related Art:

FIG. 7 of the accompanying drawings shows a conventional auto-lock slide fastener slider of the described type as disclosed in, for example, Japanese Utility Model Publication No. Sho 54-43841. In the conventional slider, a leaf spring 2' has a central base 7' concealing an eccentric axle of a pull tab, a locking pawl at a rear end of the central base 7', and a small-width front end portion 9' downwardly bent centrally from a front end of the central base 7' and fixed to a front surface of a guide post 6' of a slider body 1'. The spring 2' has at opposite sides of the front end portion 9' of the central base 7' a pair of shoulders, which are pivotally movably engages with a pair of sloping spring seats 12' projecting from an upper wing 4' of the slider body 1', and at the rear end of the central base 7' an opening whose edge is engageable with an engaging lug 15' standing on the upper wing 4'. By the action of a cam 29' formed on the axle 10' of the pull tab 3', the locking pawl of the spring 2' is brought into and out of engagement with fastener elements in response to pivotal movement of the pull tab 3' between a horizontal posture and an upright posture.

FIG. 8 shows another conventional auto-lock slide fastener slider as disclosed in U.S. Pat. No. 5,031,286. In this conventional slider, a leaf spring 2" has a central base 7" concealing an eccentric axle 10" of a pull tab 3", a locking pawl 8" at a rear end of the central base 7", a small-width front end portion 9" projecting centrally from a front end of the central base 7", a pair of front engaging strips 24" downwardly bent from opposite sides of the front end of the central base 7" and engageable with a pair of front sloping engaging lugs 12" on the upper wing 4", and an opening 26" near the rear end of the central base 7" through which opening 26" a rear engaging lug 15" on the upper wing 4" is loosely threaded. In response to pivotal movement of the pull tab 3" between a horizontal posture and an upright posture, the locking pawl 8" of the spring 2" is brought into and out of engagement with fastener elements.

In the conventional auto-lock slide fastener slider of FIG. 7, partly since the leaf spring 2' on the upper surface of the upper wing 4" is bent, and partly since the spring seats 12' project from the upper surface of the upper wing 4', the upper side of the slider is uneven and hence unsightly in appearance, and also, when the slider is pulled along a pair of rows of fastener elements, the spring seats 12' might strike something nearby and get damaged. Further, since the pull tab 3' is merely placed on the slider body, the total height of the slider is large to make the slider not stylish.

In the conventional auto-lock slide fastener slider of FIG. 8, since the leaf spring 2" is merely placed on the slider body and is supported by its own resilience, the fixing of the leaf spring 2" on the slider body is unstable. Further, since the spring 2" itself is bent at the axle 10" of the pull tab 3" to project from the upper surface of the upper wing 4", the design of the resulting slider is undesirable. And since the pull tab 3" also is merely placed on the slider body, the total height of the slider body is large to make the slider not stylish.

SUMMARY OF THE INVENTION

It is therefore a first object of this invention to provide an auto-lock slide fastener slider in which a slider body has a smooth top surface from its front end to a pull-tab-mounting portion and in which protuberances on the upper wing are concealed by a leaf spring so as not to strike something nearby, making the slider body flat and neat to increase the commercial value.

A second object of the invention is to provide an auto-lock slide fastener slider in which a locking leaf spring is reliably held on a slider body so as to move smoothly and which is desirable from a design view point.

A third object of the invention is to provide an auto-lock slide fastener slider in which a locking leaf spring can move smoothly with respect to a slider body as well as the movement of the spring can be reliably restricted.

A fourth object of the invention is to provide an auto-lock slide fastener slider in which a locking leaf spring is effectively arranged on a slider body so as to move freely within a range that is defined at a relatively low position of the slider body A fifth object of the invention is to provide an auto-lock slide fastener slider which is finished neat in appearance in view of design of a locking spring, especially design of a locking spring's front end, and can give a stabilized resiliently locking function.

A sixth object of the invention is to provide an auto-lock slide fastener slider in which a locking leaf spring is firmly fixed to a slider body and is excellent in design of fixture of the spring.

A seventh object of the invention is to provide an auto-lock slide fastener slider in which a locking leaf spring can be fixed to a slider body accurately at a predetermined position so as to be free from accidental removal.

An eighth object of the invention is to provide an auto-lock slide fastener slider in which a reliable pull-tab function for moving and locking the slider is achieved and in which a pull tab is stably held on a slider body without increasing the height of the slider.

A ninth object of the invention is to provide an auto-lock slider fastener slider in which a locking leaf spring is stably held on a slider body without jogging or otherwise malfunctioning.

According to a first aspect of the invention, there is provided an auto-lock slide fastener slider comprising a slider body, a locking leaf spring and a pull tab. The slider body is opposed of upper and lower wings joined together at their front ends by a guide post and jointly defining a fastener-element-guide channel, the upper wing having a locking-pawl-insertion hole, the guide post having in its front surface a vertical locking-spring-anchoring groove. The locking leaf spring has a streamlined central base, a smell-width front end portion downwardly bent from a front end of the central base and fixedly fitted in the locking-spring-anchoring groove and a locking pawl downwardly bent from a rear end of the central base and inserted in the locking-pawl-insertion hole so as normally to project into the fastener-element-guide channel. The pull tab has at one end an eccentric axle pivotally held between the upper wing and the central base of the locking leaf spring. The pull tab is formed so that its upper surface comes almost at a same level of an upper surface of the locking leaf spring.

According to a second aspect of the invention, the locking leaf spring has front and rear openings near the front and rear ends, respectively, of the central base, and the upper wing has front and rear lugs projecting from its upper surface, having front and rear engaging ends respectively, and loosely engaged with the front and rear openings of the locking leaf spring respectively.

According to a third aspect of the invention the locking leaf spring has a small-width engaging strip obliquely projecting from the front end of the central base into the front opening and engageable with the front engaging end, and the rear engaging end of the rear lug is engageable with an edge of the rear opening of the locking leaf spring.

According to a fourth aspect of the invention, the upper wing has at a position vertically aligned with the front lug a through-hole which communicates with the fastener-element-guide channel and in which the engaging strip of the locking leaf spring is loosely received.

According to a fifth aspect of the invention, the central base of the locking leaf spring is taper toward its front end, and the front opening has a pentagonal shape defining a substantially Y-shaped side edge portion.

According to a sixth aspect of the invention, the front end portion of the locking leaf spring has in its front surface a vertical front recess.

According to a seventh aspect of the invention, the front end portion of the locking leaf spring has in each of opposite side surfaces a side recess off its lower end.

According to an eighth aspect of the invention, the axle of the pull tab has a cam, and the upper wing has in its upper surface a cam-receiving recess between the front and rear lugs.

According to a ninth aspect of the invention, the upper wing has on its upper surface a pair of spring-supporting seats supporting with part of the Y-shaped side edge portion of the central base of the locking leaf spring.

DETAILED DESCRIPTION OF THE PREFERRED EMBODIMENT

An auto-lock slide fastener slider according to a preferred embodiment of this invention will now be described in detail with reference to the accompanying drawings.

Figure 1:
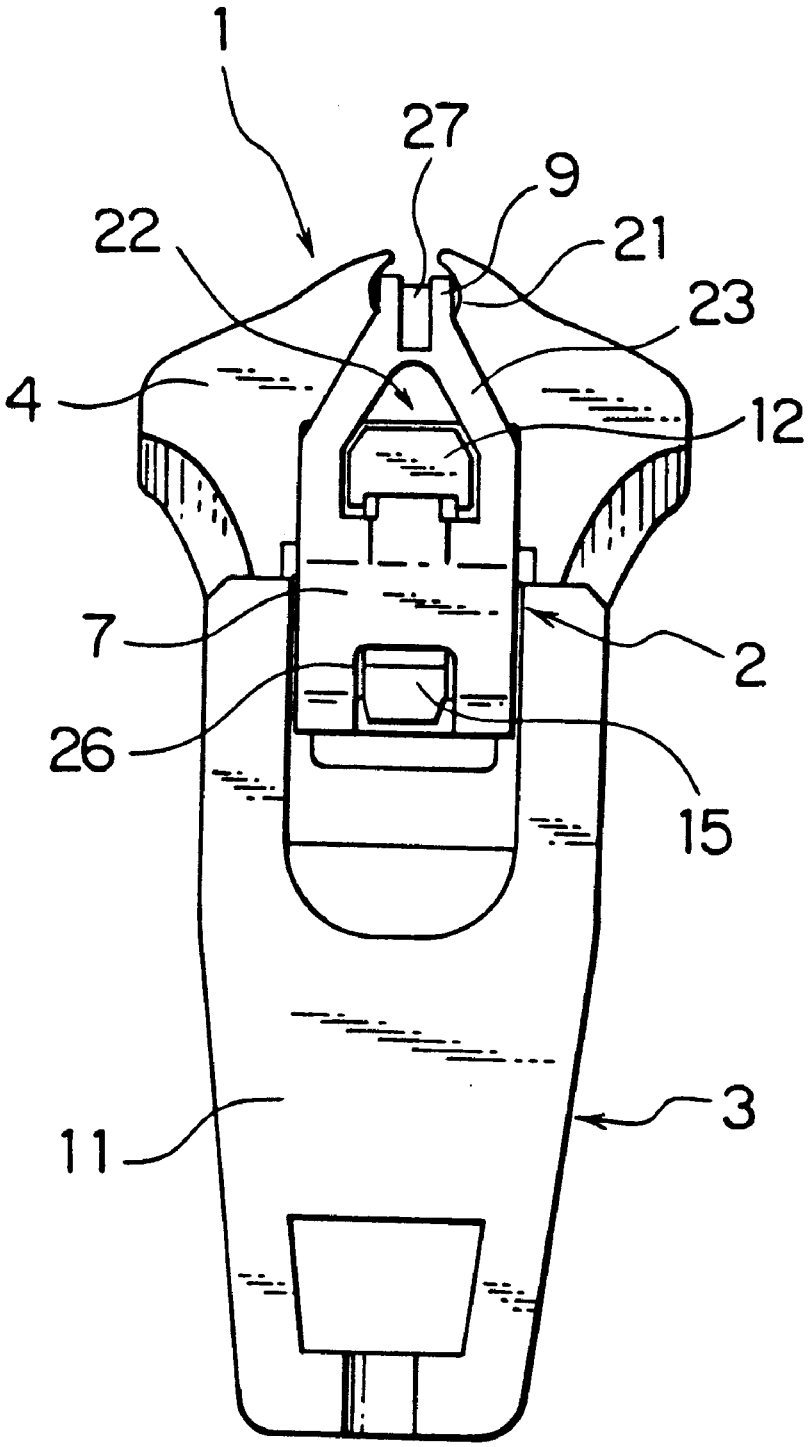
FIG. 1 is a plan view of an auto-lock slide fastener slider according to a preferred embodiment of this invention.
Figure 2:
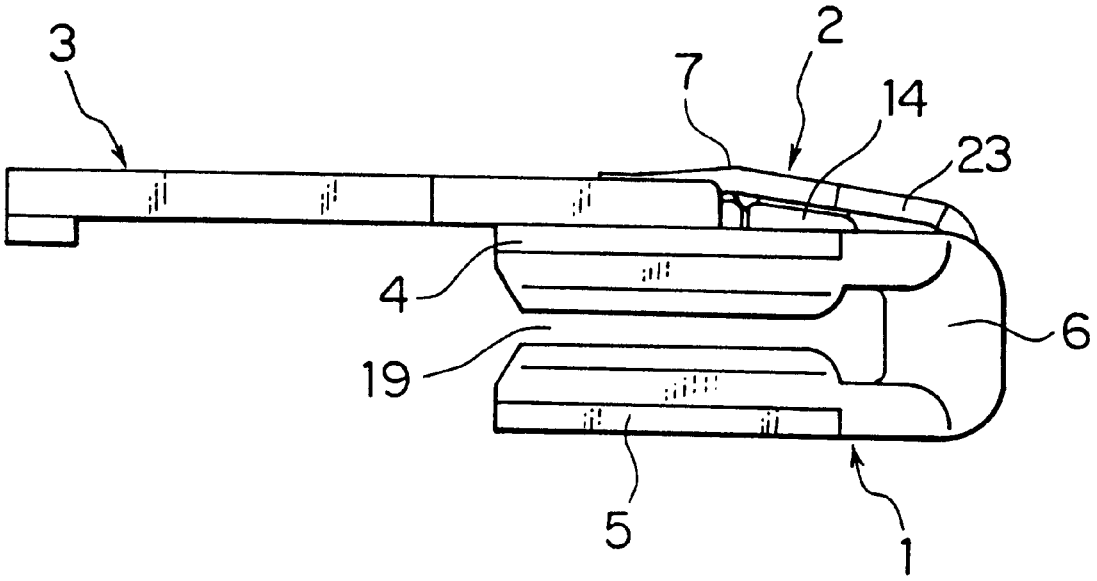
FIG. 2 is a side view of the slider of FIG. 1.
Figure 3:
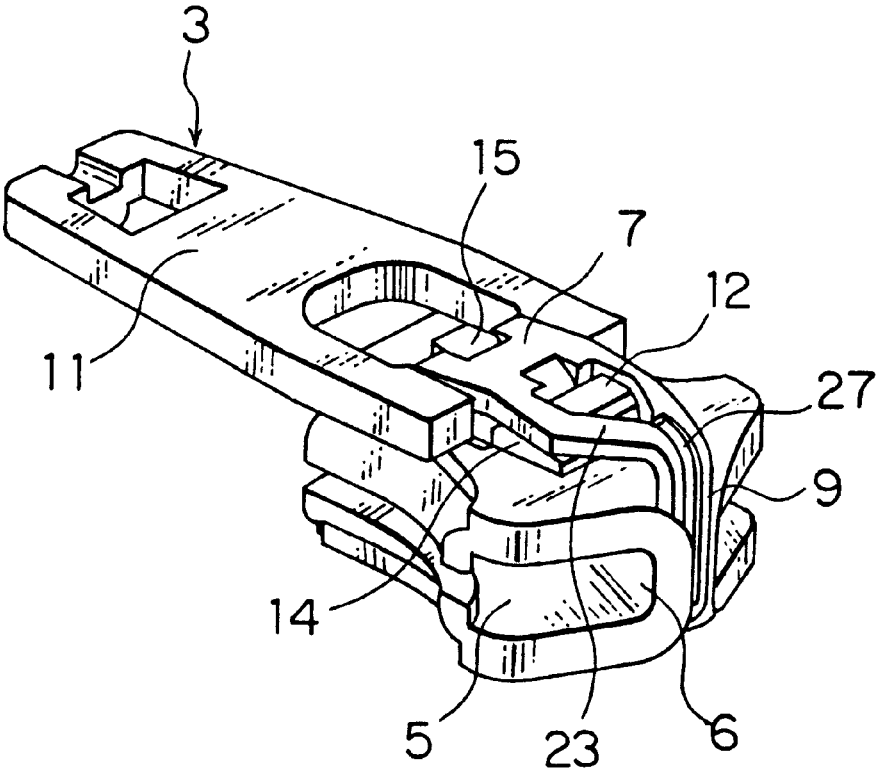
FIG. 3 is a perspective view of the slider of FIG. 1.
Figure 4:
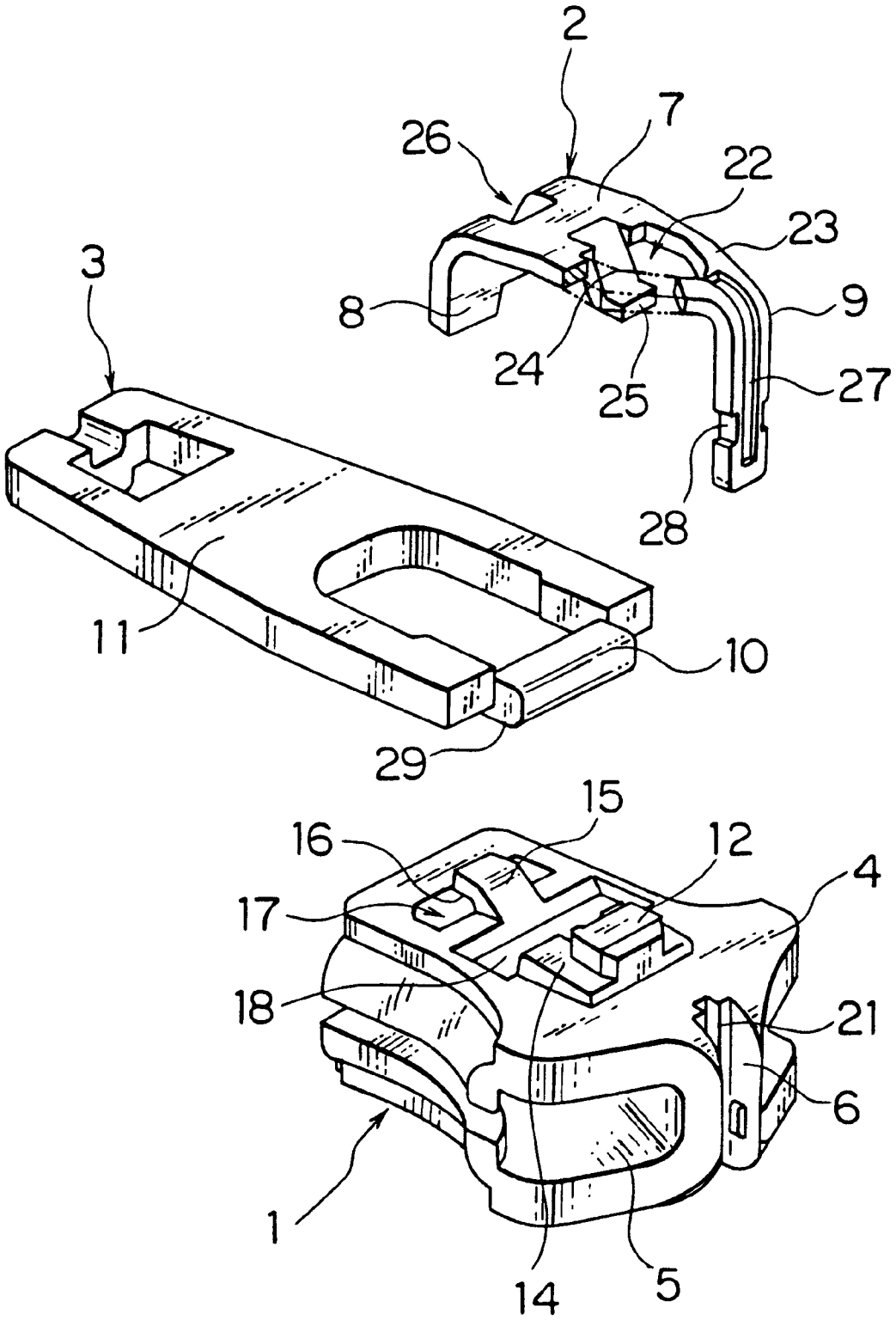
FIG. 4 is an exploded perspective view, with parts broken away, of the slider of FIG. 1.

The auto-lock slide fastener slider of the invention is an ordinary-type auto-lock slider comprising, as shown in FIG. 4, a three members, i.e., a slider body 1, a locking spring 2 and a pull tab 3, which are manufactured by punching and machining.

Figure 5:
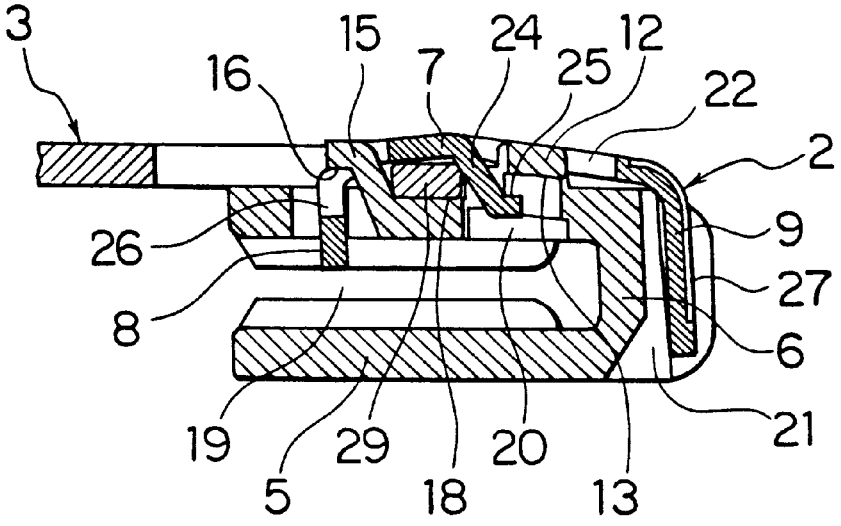
FIG. 5 is a longitudinal cross-sectional view showing the slider of FIG. 1 in locked posture.
Figure 6:
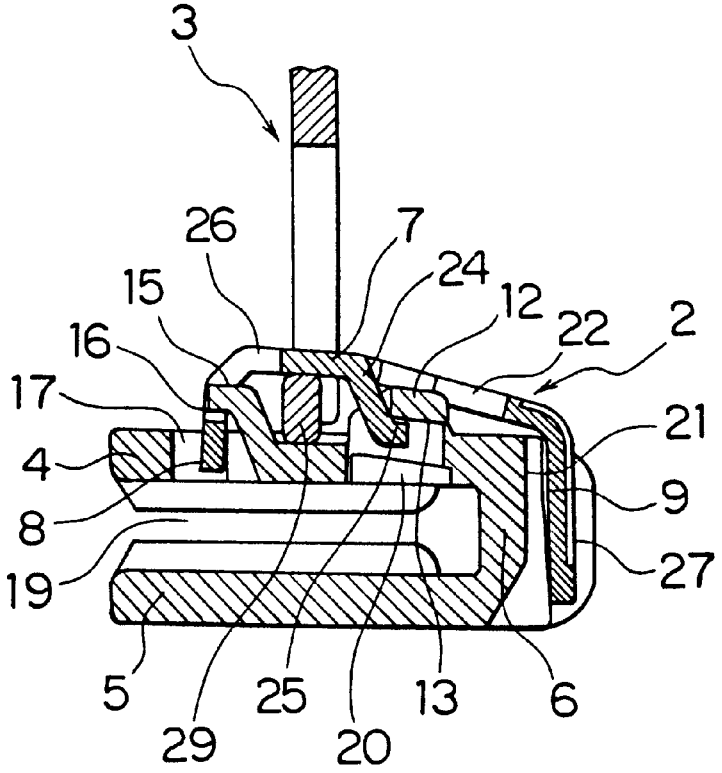
FIG. 6 is a longitudinal cross-sectional view similar to FIG. 5, but showing the slider in unlocked posture.
Figure 7:
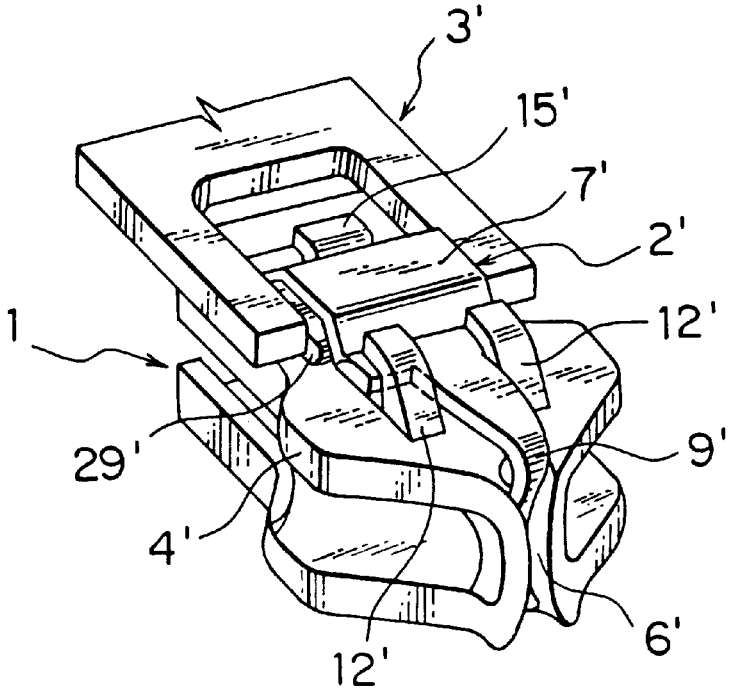
FIG. 7 PRIOR ART
FIG. 7 is a perspective view of a known auto-lock slide fastener slider.
Figure 8:
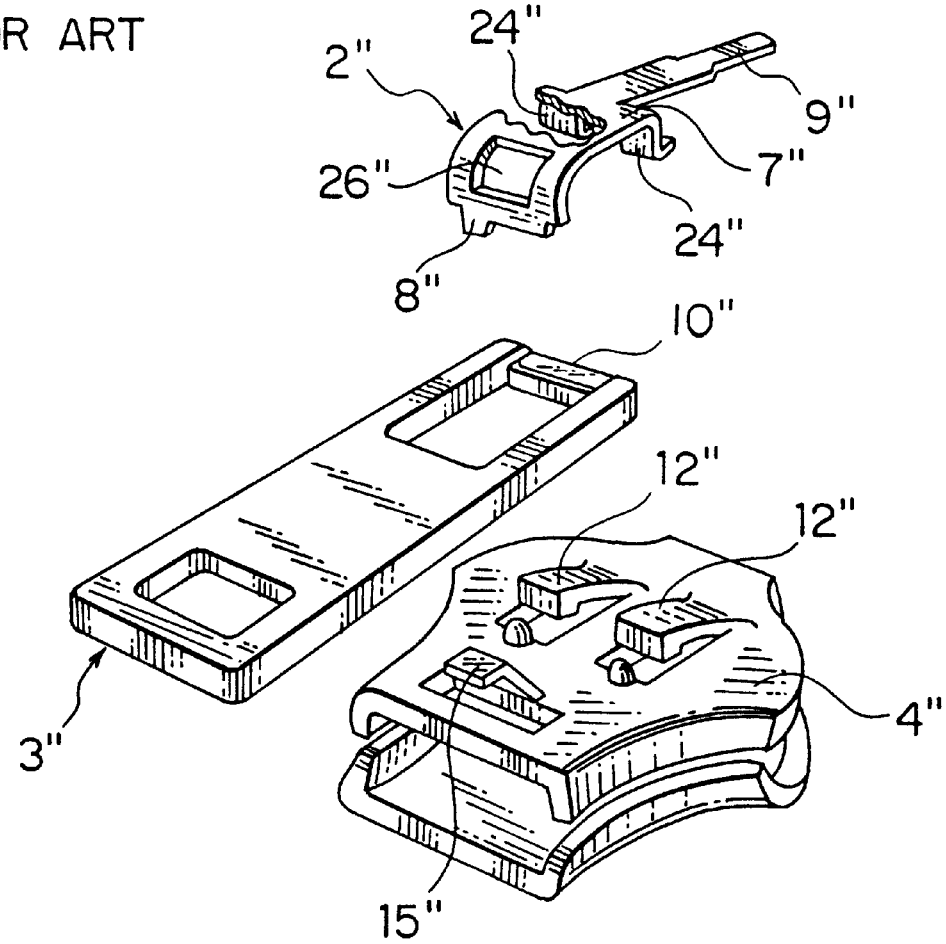
FIG. 8 PRIOR ART
FIG. 8 is an exploded perspective view, with parts broken away, of another known auto-lock slide fastener slider.

The slider body 1 is composed of upper and lower wings 4, 5 and a guide post 6 connecting the upper and lower wings 4, 5 together so as to define a Y-shaped fastener-element guide channel 19 shown in FIGS.5 and 6. The locking spring 2 is a leaf spring having a streamlined central base 7, a locking pawl 8 downwardly bent from a rear end of the central base 7, and a front end portion 9 downwardly bent from a front end of the central base 7. The pull tab 3 has at one end an eccentric axle 10 to be pivotally attached to the slider body 1 and at the other end a grip 11.

Further, the slider body 1 has on the upper wing 4 at a central position off to the front side a front lug 12 projecting from an upper surface of the upper wing 4 and having on its under surface a front engaging end 13, and at the foot of the front lug 12 a pair of spring-supporting seats 14 projecting from the upper surface of the upper wing 4 and sloping to the front side. Also the slider body 1 has on the upper wing 4 at a central position off to the rear side a rear lug 15 projecting from the upper surface of the upper wing 4 and having on its under side a rear engaging end 16, and at the foot of the rear lug 15 a locking-pawl-insertion hole 17 through which the locking pawl 8 is to be inserted.

The upper wing 4 has a cam-receiving recess 18 in its upper surface between the front and rear lugs 12, 15 for receiving a can (described below) on the axle 10 of the pull tab 3 and a through-hole 20 (see FIGS. 5 and 6) extending from the front end of the cam-receiving recess 18 to a position under the front lug 12 and communicating with the fastener-element guide channel 19 of the slider body 1. The guide post 6 has a vertical groove 21 in its front surface.

The locking leaf spring 2 has a generally C shape having at one end the locking pawl 8 and at the other end the front end portion 9; the front end portion 9 is smoothly curved from the central base 7. The central base 7 tapers to the front side and has a pentagonal front opening 22 partly defined by a Y-shaped side edge portion 23.

Also the locking leaf spring 2 has a small-width engaging strip 24 projecting from the front end of the central base 7 downwardly obliquely to the front side and having a bent end 25 engageable with a front engaging end 13 (shown in FIGS. 5 and 6) of the front lug 12, and a rear opening 26 near the rear end of the central base 7 through which opening the rear lug 15 is loosely received so that the rear engaging end 16 of the rear lug 15 is engageable with an edge of the rear opening 26.

The downwardly bent small-width front end portion 9 of the locking leaf spring 2 has in its front surface a vertical front recess 27 for reinforcing and in its opposite side surfaces a pair of side recesses -28 which serves to prevent the front end portion 9 from removing off the vertical groove 21 of the guide post 6.

The axle 10 of the pull tab 3 has a rectangular shape cross section elongated longitudinally of the pull tab 3 to form a cam 29; by the action of the cam 29, when the pull tab 3 assumes an upright posture, the spring 2 is raised to bring the locking pawl 8 out of engagement of the fastener elements in the fastener-element guide channel 19.

The manner in which the auto-lock slide fastener slider is assembled win now be described. Firstly the pull tab 3 is placed flat on the upper wing 4 of the slider body 1 with the can 29 of the axle 10 received in the cam-receiving recess 18 between the front and rear lugs 12, 15 and, as shown in FIG. 5, then the locking leaf spring 2 is placed over the axle 10 with the locking pawl 8 inserted through the locking-pawl-insertion hole 17 and with the rear opening 26 being loosely threaded by the rear lug 15 whose engaging end 16 is engageable with the edge of the rear opening 26.

Also the front opening 22 is threaded by the front lug 12, and the engaging strip 24 are inserted into the through-hole 20, which is disposed under the front lug 12, so that its engaging end 25 is engageable with the engaging end 13 of the front lug 12 while part of the Y-shaped side edge portion 23 is supported on the spring-supporting seats 14 projecting from the upper wing 4.

Further, the small-width front end portion 9 of the locking leaf spring 2 is received in the vertical groove 21 in the guide post 6 of the slider body 1, whereupon opposite side edges of the vertical groove 21 of the guide post 6 are clenched inwardly to secure the front end portion 9 of the locking leaf spring 2. During this clenching, part of the side edges of the vertical groove 21 are forced into the side recesses 28 of the front end portion 9 of the spring 2 so that the front end portion 9 is prevented from removing off the vertical groove 21. Thus the locking leaf spring 2 has been mounted on the slider body 1, completing the assembling of the slider.

In the thus assembled auto-lock slide fastener slider, when the pull tab 3 stands upright as shown in FIG. 6, the locking leaf spring 2 is raised against its own resiliency by the cam 29 of the pull tab 3 to retract the locking pawl 8 from the fastener-element guide groove 19 so that the slider can slide freely along a pair of rows of fastener elements. When the pull tab 3 is pivotally moved back to its horizontal posture as shown in FIG. 5, the locking pawl 8 enters the fastener element guide channel 19 under the resilience of the leaf spring 2 to project into an inter-element gap of the fastener element rows, thus stopping the slider. If the pull tab 3 is pivotally moved to fall flat to the front side, the locking leaf spring 2 is kept in raised posture by the action of the cam 29 so that the slider can slide freely on the fastener element rows.

With the auto-lock slide fastener slider, following advantageous results can be achieved:

According to the first aspect of the invention, partly since the locking leaf spring 2 has a streamlined central base 7 which conceals the axle 10 of the pull tab 3, a front end portion 9 downwardly bent from the front end of the central base 7 and fixed in the vertical groove 21 of the guide post 6 and a locking pawl 8 downwardly bent from the rear end of the central base 7, and partly since the pull tab 3 is formed so that its upper surface comes almost at the same level of the upper surface of the locking leaf spring 2 when assembled, the resulting slider has a smooth top surface so as not to strike something nearby and a flat and neat appearance to increase the commercial value.

According to the second aspect of the invention, partly since the locking leaf spring 2 has front and rear openings 22, 26 near the front and rear ends, respectively, of the central base 7, and partly since the upper wing 4 has front and rear lugs 12, 15 projecting from its upper surface, having front and rear engaging ends 13, 16 respectively, and loosely received in the front and rear openings 22, 26 of the locking leaf spring 2 respectively, the locking leaf spring can be reliably and easily mounted on a slider body 1 so as to move smoothly, and it is possible to obtain a slider neat in appearance.

According to the third aspect of the invention, partly since the locking leaf spring 2 has a small-width engaging strip 24 downwardly obliquely projecting from the front end of the central base 7 into the front opening 22 and engageable with the front engaging end 13, and partly since the rear engaging end 16 of the rear lug 15 is engageable with an edge of the rear opening 26 of the locking leaf spring 2, the locking leaf spring 2 can move smoothly with respect to the slider body 1 with its movement reliably restricted.

According to the fourth aspect of the invention, since the upper wing 4 has at a position vertically aligned with the front lug 12 a through-hole 20 which communicates with the fastener-element-guide channel 19 and in which the engaging strip 24 of the locking leaf spring 2 is loosely received, it is possible to reduce the height of the slider body 1 to make the slider neat in appearance.

According to the fifth aspect of the invention, partly since the central base 7 of the locking leaf spring 2 is taper toward its front end, and partly since the front opening 22 has a pentagonal shape defining a substantially Y-shaped side edge portion 23, it is possible to finish the slider neat in appearance in view of design of a locking spring and also to realize a very simplified operation of the pull tab 3.

According to the sixth aspect of the invention, since the front end portion 9 of the locking leaf spring 2 has in its front surface a vertical front recess 27, it is possible to fix the locking leaf spring 2 to the slider body 1 more firmly without deteriorating the resilient deformation of the spring 2 and also to finish the slider neatly in appearance.

According to the seventh aspect of the invention, since the front end portion 9 of the locking leaf spring 2 has in each of opposite side surfaces a side recess 28 off its lower end, it is possible to fix the locking leaf spring 2 to the slider body 1 accurately at a predetermined position by simple means like building up so as to be free from accidental removal.

According to the eighth aspect of the invention, partly since the axle 10 of the pull tab 3 has a cam 29, and partly since the upper wing 4 has in its upper surface a cam-receiving recess 18 between the front and rear lugs 12,15, it is possible to realize a reliable pull-tab function for moving and locking the slider and also to hold the pull tab 3 stably on the slider body 1 without increasing the height of the slider.

According to the ninth aspect of the invention, since the upper wing 4 has on its upper surface a pair of spring-supporting seats 14 supporting part of the Y-shaped side edge portion 23 of the central base 7 of the locking leaf spring 2, it is possible to facilitate moving of the pull tab 3 and also to hold the locking leaf spring 2 stably on the slider body 1 without jogging or otherwise malfunctioning.

What is claimed is:

1. An auto-lock slide fastener slider comprising:

(a) a slider body composed of upper and lower wings joined together at their front ends by a guide post and jointly defining a fastener-element-guide channel, said upper wing having a locking-pawl-insertion hole, said guide post having in its surface a vertical locking-spring-anchoring groove;

(b) A locking leaf spring having a streamlined central base, a small-width front end portion downwardly bent from a front end of said central base and fixedly fitted in said locking-spring-anchoring groove and a locking pawl downwardly bent from a rear end of said central base and inserted in said locking-pawl-insertion hole so as normally to project into said fastener-element-guide channel; and (c) a pull tab having at one end an eccentric axle pivotally held between said upper wing and said central base of said locking leaf spring, and its upper surface being almost at a same level as an upper surface of said locking leaf spring when assembled;

wherein said locking leaf spring has front and rear openings near said front and rear ends, respectively, of said central base, and said upper wing has front and rear lugs projecting from its upper surface and having front and rear engaging ends loosely engaged with said front and rear openings of said locking leaf spring respectively;

wherein said central base of said locking leaf spring is tapered toward its front end, and said front opening has a pentagonal shape defining a substantially Y-shaped side edge portion; and wherein said upper wing has on its upper surface a pair of springsupporting seats supporting part of said Y-shaped side edge portion of said central base of said locking leaf spring.

2. An auto-lock slide fastener slider according to claim 1, wherein said locking leaf spring has a small-width engaging strip obliquely projecting from said front end of said central base into said front opening and engageable with said front engaging end, and said rear engaging end of said rear lug is engageable with an edge of said rear opening of said locking leaf spring.

3. An auto-lock slide fastener slider according to claim 2, wherein said upper wing has at a position vertically aligned with said front lug a through-hole which communicates with said fastener-element-guide channel and in which said engaging strip of said locking leaf spring is loosely received.

4. An auto-lock slide fastener slider according to claim 1, wherein said front end portion of said locking leaf spring has in its front surface a vertical front recess.

5. An auto-lock slide fastener slider according to claim 1, wherein said front end portion of said locking leaf spring has in each of opposite side surfaces a side recess off its lower end.

6. An auto-lock slide fastener slider according to claim 1, wherein said axle of said pull tab has a cam, and said upper wing has in its upper surface a cam-receiving recess between said front and rear lugs.

* * * * *